US009666155B2

(12) United States Patent
Lee et al.

(10) Patent No.: US 9,666,155 B2
(45) Date of Patent: May 30, 2017

(54) DATA LINES DRIVER OF DISPLAY APPARATUS INCLUDNG THE SAME AND METHOD OF DRIVING DISPLAY PANEL USING THE SAME

(71) Applicant: Samsung Display Co., LTD., Yongin, Gyeonggi-Do (KR)

(72) Inventors: Sang-Gon Lee, Daejeon (KR); Yong-Sik Hwang, Yonging-si (KR); Ji-Young Eom, Daejeon (KR); Whee-Won Lee, Busan (KR)

(73) Assignee: Samsung Display Co., Ltd. (KR)

( * ) Notice: Subject to any disclaimer, the term of this patent is extended or adjusted under 35 U.S.C. 154(b) by 15 days.

(21) Appl. No.: 14/549,214

(22) Filed: Nov. 20, 2014

(65) Prior Publication Data

US 2015/0213775 A1 Jul. 30, 2015

(30) Foreign Application Priority Data

Jan. 24, 2014 (KR) ..... 10-2014-0009104

(51) Int. Cl.
*G09G 3/36* (2006.01)
*G09G 3/20* (2006.01)

(52) U.S. Cl.
CPC ..... *G09G 3/3688* (2013.01); *G09G 3/2092* (2013.01); *G09G 3/3611* (2013.01); *G09G 3/3696* (2013.01); *G09G 2310/027* (2013.01); *G09G 2320/0233* (2013.01); *G09G 2330/026* (2013.01)

(58) Field of Classification Search
CPC ..... G09G 5/006; G09G 2330/027; G09G 2310/0245; G09G 3/3648; G09G 3/325; G06F 1/24
See application file for complete search history.

(56) References Cited

U.S. PATENT DOCUMENTS

2001/0052619 A1* 12/2001 Inoue ..... H01L 27/1203 257/347
2004/0036664 A1* 2/2004 Miyazawa ..... G09G 3/325 345/76
2005/0001825 A1* 1/2005 Huang ..... G09G 5/006 345/204
2006/0071892 A1* 4/2006 Sakaguchi ..... G09G 3/3648 345/89
2008/0001873 A1* 1/2008 Choi ..... G09G 3/3655 345/87
2008/0122830 A1* 5/2008 Kotani ..... G06F 1/24 345/213

(Continued)

FOREIGN PATENT DOCUMENTS

JP 2008-187476 8/2008
JP 2010-113233 5/2010

(Continued)

*Primary Examiner* — Kevin M Nguyen
(74) *Attorney, Agent, or Firm* — Innovation Counsel LLP

(57) ABSTRACT

A data lines driver includes a digital to analog converter configured to generate a normal data voltage based on a data signal, a buffer configured to buffer the normal data voltage and a power-on/reset part configured to generate an initial data voltage varying according to time and to selectively output either the initial data voltage or the normal data voltage.

15 Claims, 8 Drawing Sheets

(56) References Cited

U.S. PATENT DOCUMENTS

| | | | | |
|---|---|---|---|---|
| 2008/0278090 | A1* | 11/2008 | Chen | G06F 1/24 315/226 |
| 2009/0002303 | A1* | 1/2009 | Huang | G09G 3/3655 345/89 |
| 2010/0103315 | A1* | 4/2010 | Li | H04N 5/70 348/500 |
| 2010/0259304 | A1* | 10/2010 | Huang | G06F 1/24 327/143 |
| 2011/0069098 | A1* | 3/2011 | Lee | G09G 3/3225 345/691 |
| 2014/0062535 | A1* | 3/2014 | Chen | H03K 17/223 327/78 |

FOREIGN PATENT DOCUMENTS

| | | | |
|---|---|---|---|
| KR | 100202081 | B1 | 3/1999 |
| KR | 100204909 | B1 | 3/1999 |
| KR | 100238485 | B1 | 10/1999 |
| KR | 1020000046786 | A | 7/2000 |
| KR | 102000055940 | A | 9/2000 |
| KR | 1020040069836 | A | 8/2004 |
| KR | 1020060100536 | A | 9/2006 |
| KR | 1020060131227 | A | 12/2006 |
| KR | 1020110088797 | A | 8/2011 |

* cited by examiner

DATA LINES DRIVER OF DISPLAY APPARATUS INCLUDNG THE SAME AND METHOD OF DRIVING DISPLAY PANEL USING THE SAME

PRIORITY STATEMENT

This application claims priority under 35 U.S.C. §119 to Korean Patent Application No. 10-2014-0009104, filed on Jan. 24, 2014 in the Korean Intellectual Property Office KIPO, the contents of which application are herein incorporated by reference in their entireties.

BACKGROUND

1. Field

The present disclosure of inventive concept(s) relates to a data lines driver of display apparatus, to a display apparatus including the data lines driver and to a method of driving the display panel using the data lines driver. More particularly, the present disclosure relates to a data lines driver that is configured to improving display quality during a power up mode, to a display apparatus including the data lines driver and to a method of driving the display panel using the data lines driver.

2. Description of Related Technology

Generally, a liquid crystal display ("LCD") apparatus includes a first substrate including a plurality of pixel electrodes arranged in a matrix format, a spaced apart second substrate that often includes a common electrode opposing the pixel electrodes and a liquid crystal layer disposed between the first and second substrates. Respective electric fields are generated by respective voltages applied to the pixel electrodes relative top that on the common electrode. By adjusting an intensity of each electric field, a transmittance of a light passing through the liquid crystal layer in the region of the respective pixel may be adjusted so that a desired image may be formed and displayed.

Generally, a display apparatus includes a display panel (having the first and second substrates) and one or more panel line drivers where one or more of the drivers may be monolithically integrated on the first substrate. The first substrate of the display panel includes a plurality of gate lines extending in a first direction and a plurality of data lines extending in a second direction and crossing with the gate lines. The panel lines drivers include a gate lines driver providing gate signals to respective ones of the gate lines and a data lines driver providing data voltages to respective ones of the data lines.

When the display apparatus is turned on (powered up), the display panel may display abnormal images as its power supplies transition from an off or asleep mode to a stable powered up mode. In other words, the images may be unstable before one or more power voltages, common voltages and/or data drive voltages of the display apparatus transition to reach respective, normal (fully powered up and stabilized) levels.

Due to the irregularity of the display quality of the display panel during an initial power up and driving time, a user of the display apparatus may feel uncomfortable and concerned that something may be wrong such that the perceived reliability of the display apparatus may be reduced. The problem of prolonged power up and irregular display may be particularly pronounced in high resolution large area displays which tend to have larger common electrode and panel line capacitances and thus take longer to all charge up at once to normal states.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

The present disclosure of inventive concept(s) provides a data lines driver configured for improving display quality particularly during a power-up or awakening mode of operation of a display device.

Exemplary embodiments in accordance with the present inventive concept(s) also provide a display apparatus including the data lines driver.

Exemplary embodiments also provide a method of driving a display panel using the data lines driver.

In an exemplary embodiment of a data lines driver in accordance with the present inventive concept(s), the data lines driver includes a digital-to-analog converter (DAC) configured to generate a normal data voltage signal based on a supplied data signal, a buffer configured to buffer the normal data voltage signal and a power-on/reset part configured to generate an initial data voltage signal where the latter varies as a function of time and where the power-on/reset part is further configured to selectively output either the initial data voltage signal or the normal data voltage signal.

In an exemplary embodiment, the power-on/reset part may include an initial data voltage signal generating part configured to generate the initial data voltage signal based on a supplied first power voltage and a supplied second power voltage, a switching part configured to selectively output one of the initial data voltage signal and the normal data voltage signal and a power-on/reset control part configured to generate a power-on/reset signal and an inverted power-on/reset signal to control operations of the initial data voltage signal generating part and of the switching part.

In an exemplary embodiment, the initial data voltage signal generating part may include a first switching element, a first resistor, a second resistor and a second switching element. The first switching element, the first resistor, the second resistor and the second switching element may be connected to one another in series.

In an exemplary embodiment, the first switching element may include a control electrode to which the inverted power-on/reset signal is applied, an input electrode to which the first power voltage is applied and an output electrode connected to a first end of the first resistor. The first resistor may include the first end connected to the output electrode of the first switching element and a second end connected to a first end of the second resistor. The second resistor may include the first end connected to the second end of the first resistor and a second end connected to an input electrode of the second switching element. The second switching element may include a control electrode to which the power-on/reset signal is applied, the input electrode connected to the second end of the second resistor and an output electrode to which the supplied second power voltage is applied. The first switching element may be a P-type transistor. The second switching element may be an N-type transistor.

In an exemplary embodiment, the power-on/reset control part may receive an input voltage produced by a power supply of a display apparatus and a power-on/reset control signal representing at least a beginning of a normal operation mode of a timing controller. When the input voltage begins to exceed a predetermined threshold, the power-on/reset control part may set the power-on/reset signal as a high level and the inverted power-on/reset signal as a low level. When the power-on/reset control signal has a high level, the power-on/reset control part may set the power-on/reset signal as a low level and the inverted power-on/reset signal as a high level.

In an exemplary embodiment, the switching part may include a third switching element comprising a control electrode to which the power-on/reset signal is applied, an input electrode to which the initial data voltage signal is applied and an output electrode connected to a data line of the display apparatus and further a fourth switching element comprising a control electrode to which the inverted power-on/reset signal is applied, an input electrode to which the normal data voltage signal is applied and an output electrode connected to a corresponding data line of the display apparatus.

In an exemplary embodiment, the power-on/reset part may include a fifth switching element, a first digital resistor, a second digital resistor, a sixth switching element, a voltage sensing part and a feedback part. The fifth switching element, the first digital resistor, the second digital resistor and the sixth switching element may be connected to one another in series. The voltage sensing part may be connected to the first digital resistor and the second digital resistor. The feedback part may stabilize the initial data voltage signal.

In an exemplary embodiment, the fifth switching element may include a control electrode to which the inverted power-on/reset signal is applied, an input electrode to which the first power voltage is applied and an output electrode connected to a first end of the first digital resistor. The first digital resistor may include the first end connected to the output electrode of the fifth switching element and a second end connected to a first end of the second digital resistor. The second digital resistor may include the first end connected to the second end of the first digital resistor and a second end connected to an input electrode of the sixth switching element. The sixth switching element may include a control electrode to which the power-on/reset signal is applied, the input electrode connected to the second end of the second digital resistor and an output electrode to which the second power voltage is applied. The fifth switching element may be a P-type transistor. The sixth switching element may be an N-type transistor.

In an exemplary embodiment, the initial data voltage signal may be proportional to the first power voltage.

In an exemplary embodiment, the initial data voltage signal may vary in a substantially same manner as does a common voltage signal of the display panel.

In an exemplary embodiment, the initial data voltage may be substantially a half of the first power voltage.

In an exemplary embodiment of a display apparatus according to the present disclosure, the display apparatus includes a display panel configured to display an image, a timing controller configured to generate a data signal based on input image data, a voltage generator configured to generate a digital power voltage, an analog power voltage and a common voltage based on an input voltage, to output the digital power voltage to the timing controller and a data lines driver, to output the analog power voltage to the data lines driver and to output the common voltage to the display panel and the data lines driver comprising a digital-to-analog converter (DAC) configured to generate a normal data voltage signal based on a data signal, a buffer configured to buffer the normal data voltage signal and a power-on/reset part configured to generate an initial data voltage signal which varies according to time and to selectively output one of the initial data voltage signal and the normal data voltage signal.

In an exemplary embodiment, the power-on/reset part may include an initial data voltage signal generating part configured to generate the initial data voltage signal based on the analog power voltage and a second power voltage, a switching part configured to selectively output either the initial data voltage signal or the normal data voltage signal and a power-on/reset control part configured to generate a power-on/reset signal and an inverted power-on/reset signal to control operations of the initial data voltage signal generating part and of the switching part.

In an exemplary embodiment, the initial data voltage signal generating part may include a first switching element, a first resistor, a second resistor and a second switching element. The first switching element, the first resistor, the second resistor and the second switching element may be connected to one another in series.

In an exemplary embodiment, the power-on/reset control part may receive an input voltage of a display apparatus and a power-on/reset control signal representing a normal operation of a timing controller. When the input voltage rises to exceed a predetermined threshold, the power-on/reset control part may set the power-on/reset signal as a high level and the inverted power-on/reset signal as a low level. Later, when the power-on/reset control signal has a high level, the power-on/reset control part may set the power-on/reset signal as a low level and the inverted power-on/reset signal as a high level.

In an exemplary embodiment, the switching part may include a third switching element comprising a control electrode to which the power-on/reset signal is applied, an input electrode to which the initial data voltage signal is applied and an output electrode coupled to a respective data line and a fourth switching element comprising a control electrode to which the inverted power-on/reset signal is applied, an input electrode to which the normal data voltage signal is applied and an output electrode connected to the respective data line.

In an exemplary embodiment, the power-on/reset part may include a fifth switching element, a first digital resistor, a second digital resistor, a sixth switching element, a voltage sensing part and a feedback part. The fifth switching element, the first digital resistor, the second digital resistor and the sixth switching element may be connected to one another in series. The voltage sensing part may be connected to the first digital resistor and the second digital resistor. The feedback part may stabilize the initial data voltage.

In an exemplary embodiment, the display panel may have a normally black mode.

In an exemplary embodiment, the initial data voltage may be proportional to the analog power voltage.

In an exemplary embodiment of a method of driving a display panel according to the present disclosure, the method includes generating a data signal based on input image data, generating a normal data voltage signal based on the data signal, generating an initial data voltage signal varying according to time and selectively outputting either the initial data voltage signal or the normal data voltage signal to the display panel.

According to the data lines driver, the display apparatus including the data lines driver and the method of driving the display panel using the data lines driver, in the initial driving time when the power voltage, the common voltage signal and the data voltage signal do not represent desired levels, a proper initial data voltage signal is generated and applied to the data lines so that a display quality of the display panel may be improved.

BRIEF DESCRIPTION OF THE DRAWINGS

The above and other features and advantages of the present disclosure of inventive concept(s) will become more apparent by describing in detail exemplary embodiments thereof with reference to the accompanying drawings, in which.

DETAILED DESCRIPTION

Hereinafter, the present inventive concept(s) will be explained in further detail with reference to the accompanying drawings.

Figure 1:
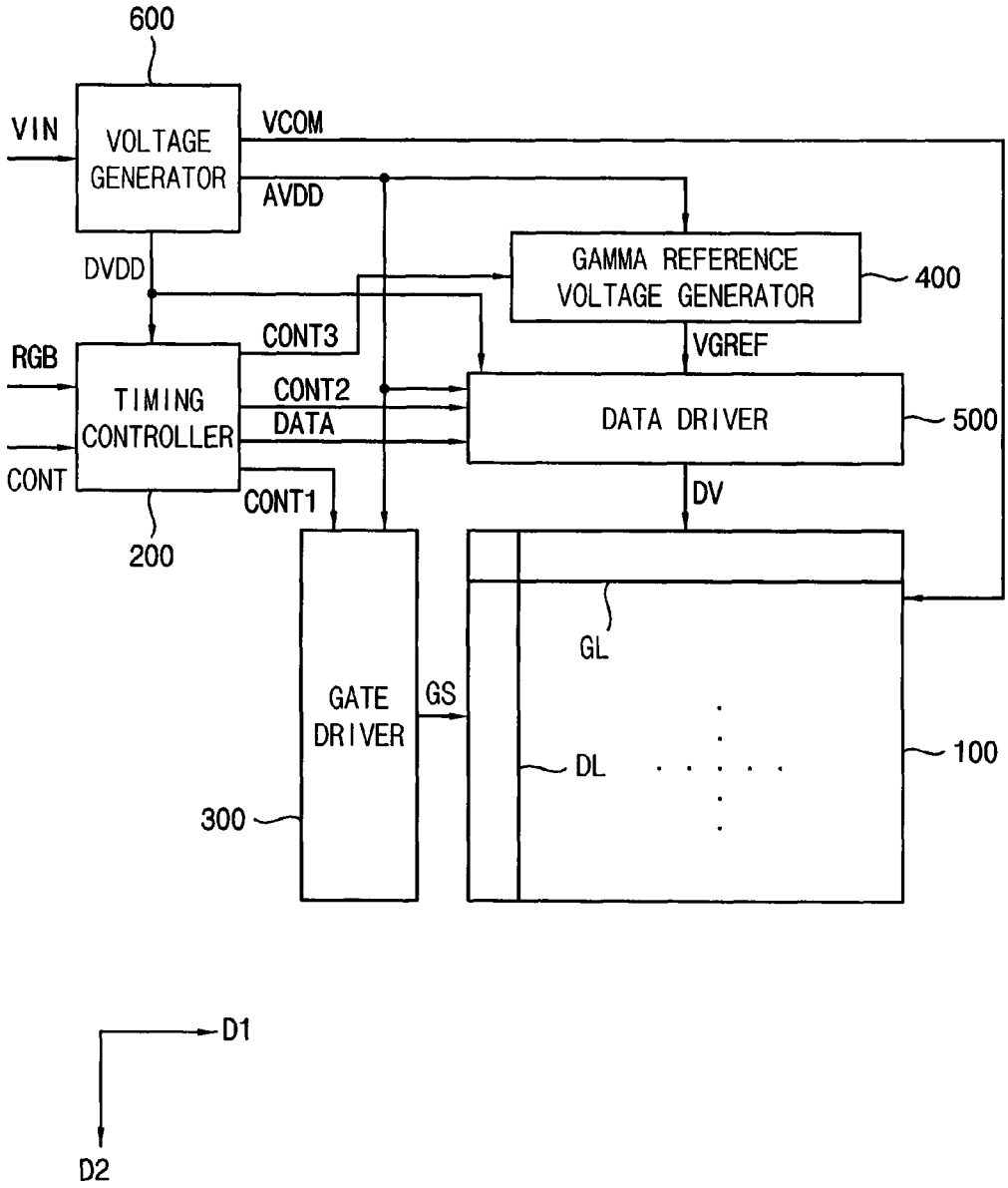
FIG. 1 is a block diagram illustrating a display apparatus according to an exemplary embodiment of the present disclosure.

FIG. 1 is a block diagram illustrating a display apparatus according to an exemplary embodiment in accordance with the present disclosure of inventive concept(s).

Referring to FIG. 1, the display apparatus includes a display panel 100 and a plurality of panel line drivers. The panel line drive circuitry includes a timing controller 200, a gate lines driver 300, a gamma reference voltage generator 400, a data lines driver 500 and a voltage generator 600.

The display panel 100 has a display region on which an image is displayed and a non-displaying peripheral region adjacent to the display region. In one embodiment, the display area (DA, a.k.a. display region) is rectangular and has a diagonal dimension of 36 inches or greater. In one embodiment, the display device is a high resolution one having 2048 or more rows of pixels.

More specifically, the display panel 100 includes a plurality of gate lines GL, a plurality of data lines DL and a plurality of pixels each connected to a corresponding one of the gate lines GL and a corresponding one of the data lines DL. The gate lines GL extend in a first direction D1 and the data lines DL extend in a second direction D2 crossing the first direction D1.

The display panel 100 may have a normally black, display mode. For example, the display panel 100 may be a plane to line switching ("PLS") type of panel.

Each pixel includes a switching element (not shown), a liquid crystal capacitor (not shown) and a storage capacitor (not shown). The liquid crystal capacitor and the storage capacitor are connected to the switching element. The pixels may be disposed in a matrix form.

The timing controller 200 receives an input image data signal RGB and an input control signal CONT from an external apparatus (not shown). The input image data signal may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data signal RGB and the input control signal CONT.

The timing controller 200 generates the first control signal CONT1 for controlling an operation of the gate lines driver 300 based on the input control signal CONT, and outputs the first control signal CONT1 to the gate lines driver 300. The first control signal CONT1 may include a vertical start signal and a gate clock signal.

The timing controller 200 generates the second control signal CONT2 for controlling an operation of the data lines driver 500 based on the input control signal CONT, and outputs the second control signal CONT2 to the data lines driver 500. The second control signal CONT2 may include a horizontal start signal and a load signal. The second control signal CONT2 may further include a power-on/reset control signal which is automatically asserted during system power up and/or reset operations.

The timing controller 200 generates the data signal DATA based on the input image data signal RGB. The timing controller 200 outputs the data signal DATA to the data lines driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate lines driver 300 generates respective gate signals GS for driving respective ones of the gate lines GL in response to the first control signal CONT1 received from the timing controller 200. The gate lines driver 300 sequentially outputs row-activating ones of the gate signals GS to the gate lines GL.

The gate lines driver 300 may be directly mounted on the display panel 100, or may be connected to the display panel 100 as a tape carrier package ("TCP") type. Alternatively, the gate lines driver 300 may be monolithically integrated on the display panel 100.

The gamma reference voltage generator 400 generates one or more gamma reference voltages VGREF in response to the third control signal CONT3 received from the timing controller 200. The gamma reference voltage generator 400 provides the gamma reference voltage(s) VGREF to the data lines driver 500. The gamma reference voltage(s) VGREF has/have analog values corresponding to represented levels of the digital data signal DATA.

In an exemplary embodiment, the gamma reference voltage generator 400 may be disposed inside the timing controller 200, or inside the data lines driver 500.

The data lines driver 500 receives the second control signal CONT2 and the data signal DATA from the timing controller 200, and receives the gamma reference voltages VGREF from the gamma reference voltage generator 400. The data lines driver 500 converts the data signal DATA into respective data voltages DV for respective ones of the data lines, with each data voltage signal DV having an analog type form that uses the gamma reference voltages VGREF as a calibration source. The data lines driver 500 outputs the data voltages DV to the respective data lines DL.

The data lines driver 500 may be directly mounted on the display panel 100, or be connected to the display panel 100 in a TCP type. Alternatively, the data lines driver 500 may be monolithically integrated on the display panel 100.

A structure of the data lines driver 500 will be explained by referring to FIGS. 2 to 4B in detail.

The voltage generator 600 of FIG. 1 generates various voltages used to drive the display panel 100, the timing controller 200, the gate lines driver 300, the gamma reference voltage generator 400 and the data lines driver 500.

For example, the voltage generator 600 generates a digital power voltage DVDD, an analog power voltage AVDD and a common voltage VCOM.

The voltage generator 600 outputs the digital power voltage DVDD to the timing controller 200 and to the data lines driver 500.

The voltage generator 600 outputs the analog power voltage AVDD to the data lines driver 500. The voltage generator 600 may output the analog power voltage AVDD further to the gate lines driver 300 and to the gamma reference voltage generator 400.

The voltage generator 600 outputs the common voltage VCOM to the display panel 100, more specifically, for driving one or more common electrodes of the panel. The common voltage VCOM may be generated based on the level of the analog power voltage AVDD. More specifically, the common voltage VCOM may be proportional to the analog power voltage AVDD. In one embodiment, the common voltage VCOM is about half the level of the analog power voltage AVDD such that an upper half of voltage levels included under AVDD are of positive polarity relative to VCOM and a lower half are of negative polarity relative to VCOM.

Figure 2:
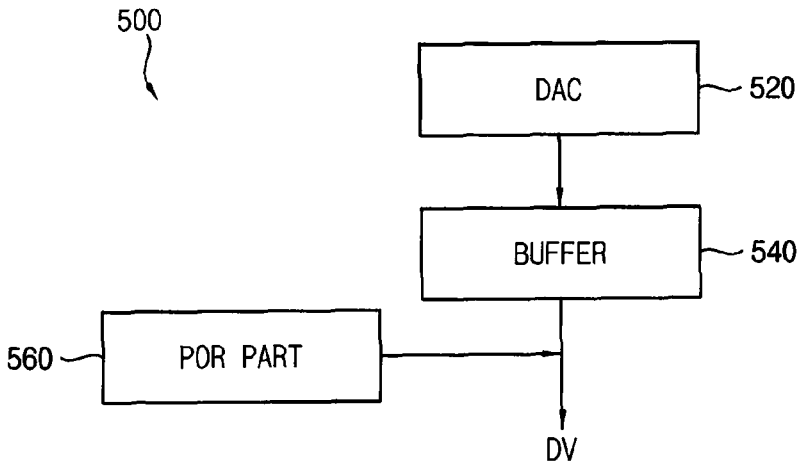
FIG. 2 is a block diagram illustrating a general structure for a data lines driver included in FIG. 1.
Figure 3:
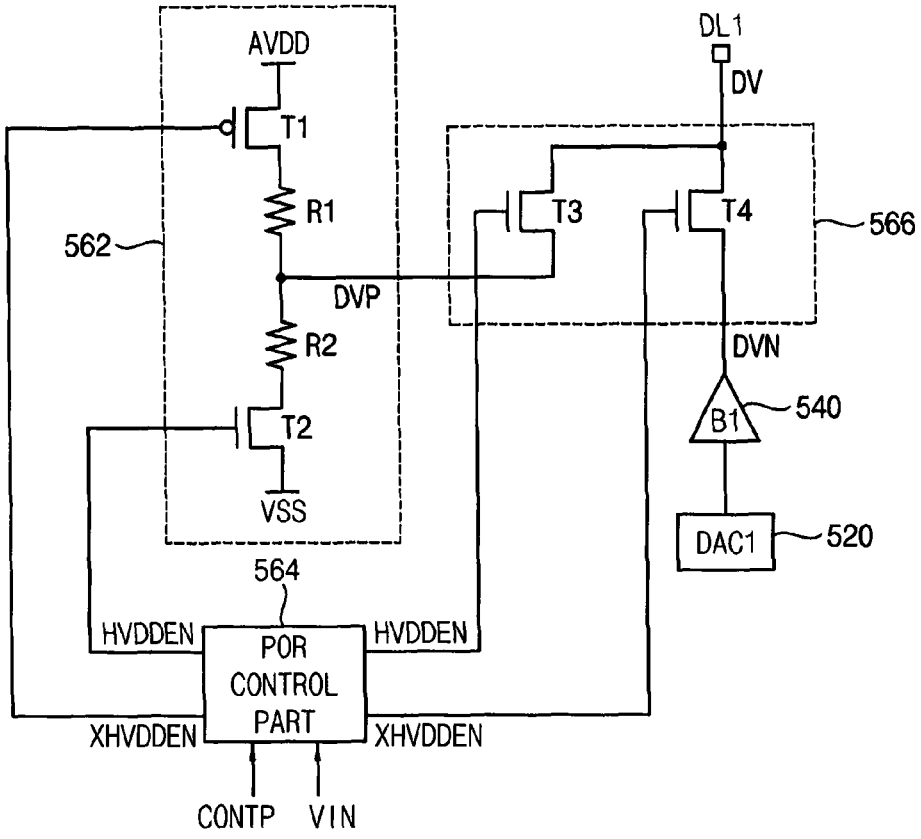
FIG. 3 is a circuit diagram illustrating a first embodiment of the data lines driver of FIG. 2.

FIG. 2 is a block diagram illustrating a basic structure for the data lines driver 500 of FIG. 1. FIG. 3 is a circuit diagram illustrating a specific embodiment of the data lines driver 500 of FIG. 1.

Referring to FIGS. 1 to 3, the data lines driver 500 includes a digital to analog converter (DAC) 520, an analog buffer 540 and a power-on/reset (POR) part 560.

When the system is in a normal, powered up and stable mode, the digital to analog converter 520 generates a normal data voltage DVN based on the supplied data signal DATA and on the supplied gamma reference voltage(s) VGREF. The digital to analog converter 520 outputs the normal data voltage DVN to the buffer 540.

The buffer 540 buffers the normal data voltage DVN to maintain a uniform level. The buffer 540 outputs the buffered normal data voltage DVN for application to the associated data line DL by way of a selective coupling part 566 (a.k.a. switching part 566).

The power-on/reset part 560 generates an initial data voltage DVP varying according to time. The power-on/reset part 560 selectively outputs the initial data voltage DVP and the normal data voltage DVN.

The power-on/reset part 560 includes the aforementioned switching part 566 (a.k.a. selective coupling part 566) as well as an initial data voltage generating part 562 and a power-on/reset control part 564.

The initial data voltage generating part 562 generates an initial data voltage signal DVP which is a function of a generated first power voltage AVDD (obtained from voltage generator 600 of FIG. 1) and of a second power voltage VSS. More specifically, the first power voltage AVDD is the analog power voltage currently received from the voltage generator 600 and the second power voltage VSS is a reference voltage such as a power supply ground voltage.

Yet more specifically, the initial data voltage signal DVP may be caused to be a voltage division product in the range of levels between AVDD and VSS. For example, the initial data voltage generating part 562 may include a first switching element T1 (a PMOS transistor), a first resistor R1, a second resistor R2 and a second switching element T2 (an NMOS transistor).

The first switching element T1 may include a control electrode to which an inverted power-on/reset signal HVDDEN is applied, and an input electrode to which the first power voltage AVDD is applied and an output electrode connected to a first end of the first resistor R1.

The first resistor R1 includes the first end connected to the output electrode of the first switching element T1 and a second end connected to a first end of the second resistor R2.

The second resistor R2 includes the first end connected to the second end of the first resistor and a second end connected to an input electrode of the second switching element T2.

The second switching element T2 may include a control electrode to which power-on/reset signal XHVDDEN is applied, and an input electrode connected to the second end of the second resistor and an output electrode to which the second power voltage VSS is applied.

Given the exemplary case where the first switching element T1 is a P-type transistor and the second switching element T2 is an N-type transistor, when the power-on/reset signal HVDDEN is high (logic 1) and the inverted power-on/reset signal XHVDDEN is low, both of transistors T1 and T2 are switched into respective conductive states (both are turned on).

An output of the voltage divider of the initial data voltage generating part 562 is defined by a node between the first resistor R1 and the second resistor R2. A voltage which is a difference between the first power voltage AVDD and the second power voltage VSS is divided by the first resistor R1 and the second resistor R2 so that the output terminal of the initial data voltage generating part 562 outputs the initial data voltage DVP.

Thus, the initial data voltage DVP may be proportional to (e.g., a sub-unity fraction of) the first power voltage AVDD.

For example, the first resistor R1 may have a resistance substantially the same as a resistance of the second resistor R2. When the second power voltage VSS is the ground voltage, the initial data voltage DVP may be substantially equal to half of the first power voltage AVDD.

For example, the initial data voltage DVP may thereby be caused to be substantially the same as the common voltage VCOM of the display panel 100. Accordingly, when the initial data voltage DVP is applied to the pixel electrodes of the display area, there is essentially no voltage difference between the common electrode and the pixel electrodes such that the liquid crystals remain in their alignment-layer induced orientations (which in one embodiment, appears as a black screen).

The power-on/reset control part 564 generates the power-on/reset signal HVDDEN and the inverted power-on/reset signal XHVDDEN to control an operation of the initial data voltage generating part 562 and the switching part 566. When the power-on/reset signal HVDDEN has a high level, the data lines driver 500 outputs the initial data voltage DVP to the data line DL. When the inverted power-on/reset signal XHVDDEN has a high level, the data lines driver 500 outputs the normal data voltage DVN to the data line DL.

The power-on/reset control part 564 receives an input voltage VIN of the display apparatus and a power-on/reset control signal CONTP where the latter is high during a normal operation of the timing controller 200 and low during a power-up and/or awakening from sleep mode of the timing controller 200.

When the received input voltage VIN begins to exceed a predetermined threshold voltage but CONTP is low, the power-on/reset control part 564 sets its power-on/reset signal HVDDEN to the high level and the inverted power-on/reset signal XHVDDEN to the low level (thus turning on T1 and T2). This state of affairs where the input voltage VIN begins exceeding the predetermined threshold voltage indicates that the display apparatus is being turned on.

Then later, when the power-on/reset control signal CONTP switches to the high level, the power-on/reset control part 564 resets its power-on/reset signal HVDDEN to the low level and its inverted power-on/reset signal XHVDDEN to the high level (thus turning off T1 and T2). This state of affairs where the power-on/reset control signal CONTP switches up to the high level means that the timing controller 200 has begun to operate normally as supposed to being in a powered off and/or asleep state. For example, in one embodiment, after the timing controller 200 outputs four consecutive pulses of a load signal TP, the power-on/reset control signal CONTP is responsively switched to the high level (for example by a counter (not shown) that is coupled to count the number of TP pulses).

The switching part 566 thereby selectively outputs either the initial data voltage DVP or the normal data voltage DVN.

The switching part 566 includes a third switching element T3 and a fourth switching element T4 (both NMOS). The third switching element T3 includes a control electrode to which the power-on/reset signal HVDDEN is applied, an input electrode to which the initial data voltage DVP is applied and an output electrode connected to the data line DL. The fourth switching element T4 includes a control electrode to which the inverted power-on/reset signal XHVDDEN is applied, an input electrode to which the normal data voltage DVN is applied and an output electrode connected to the data line DL.

Since in the given example, the third and fourth switching elements, T3 and T4 are N-type transistors, T3 is turned on only during the power-up state and T4 is turned on only afterwards, during the normal power state.

Although a first buffer B1 and a first digital to analog converter DAC1 connected to the first data line DL1 are illustrated in FIG. 3 for convenience of explanation, the data lines driver 500 may include a plurality of buffers and a plurality of digital to analog converters corresponding to the number of the data lines DL.

Figure 4A:
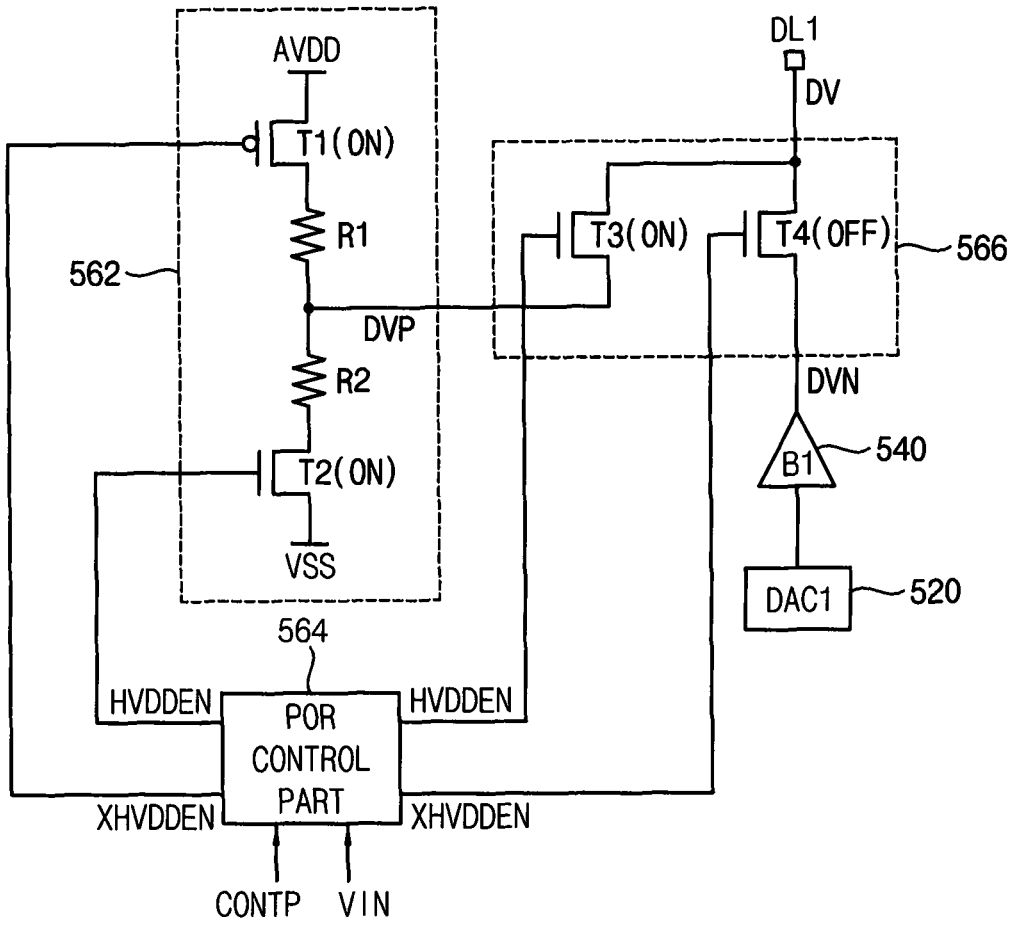
FIG. 4A is a circuit diagram illustrating a first mode of operation of the data lines driver of FIG. 3 (the initial driving time mode)
Figure 4B:
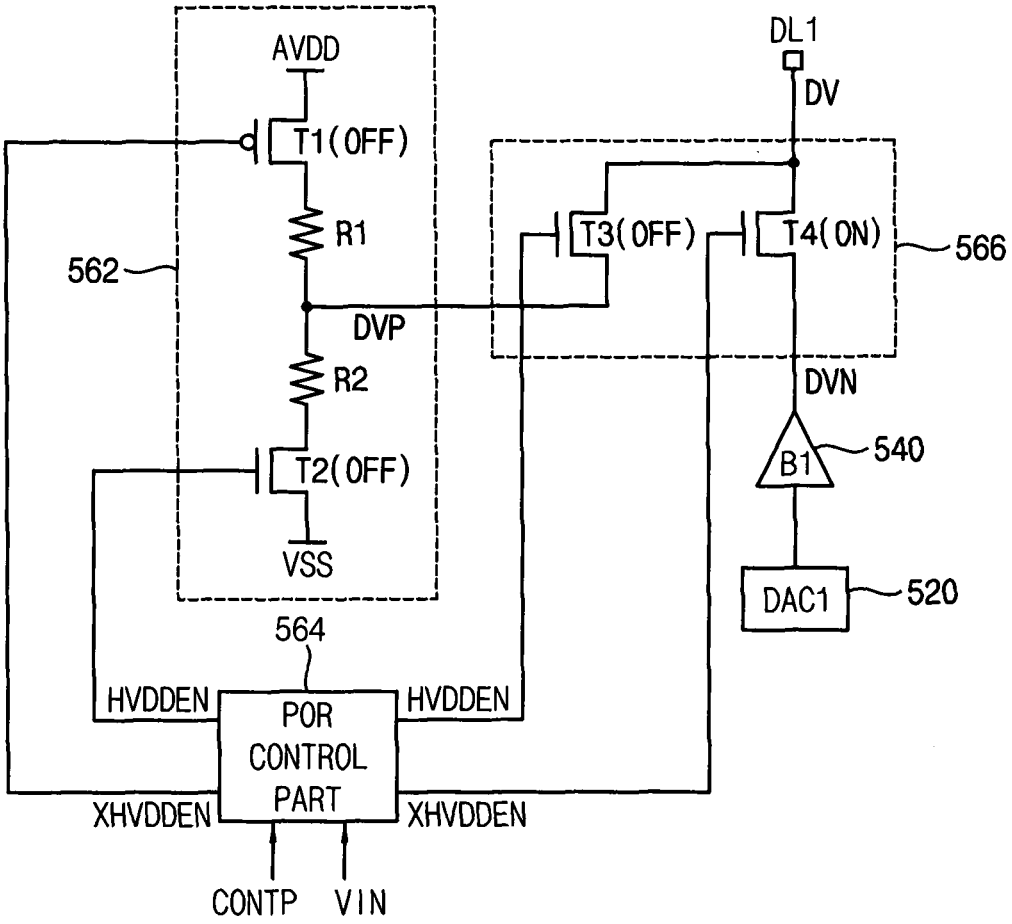
FIG. 4B is a circuit diagram illustrating a second mode of operation of the data lines driver of FIG. 3 (the normal driving time mode)
Figure 5:
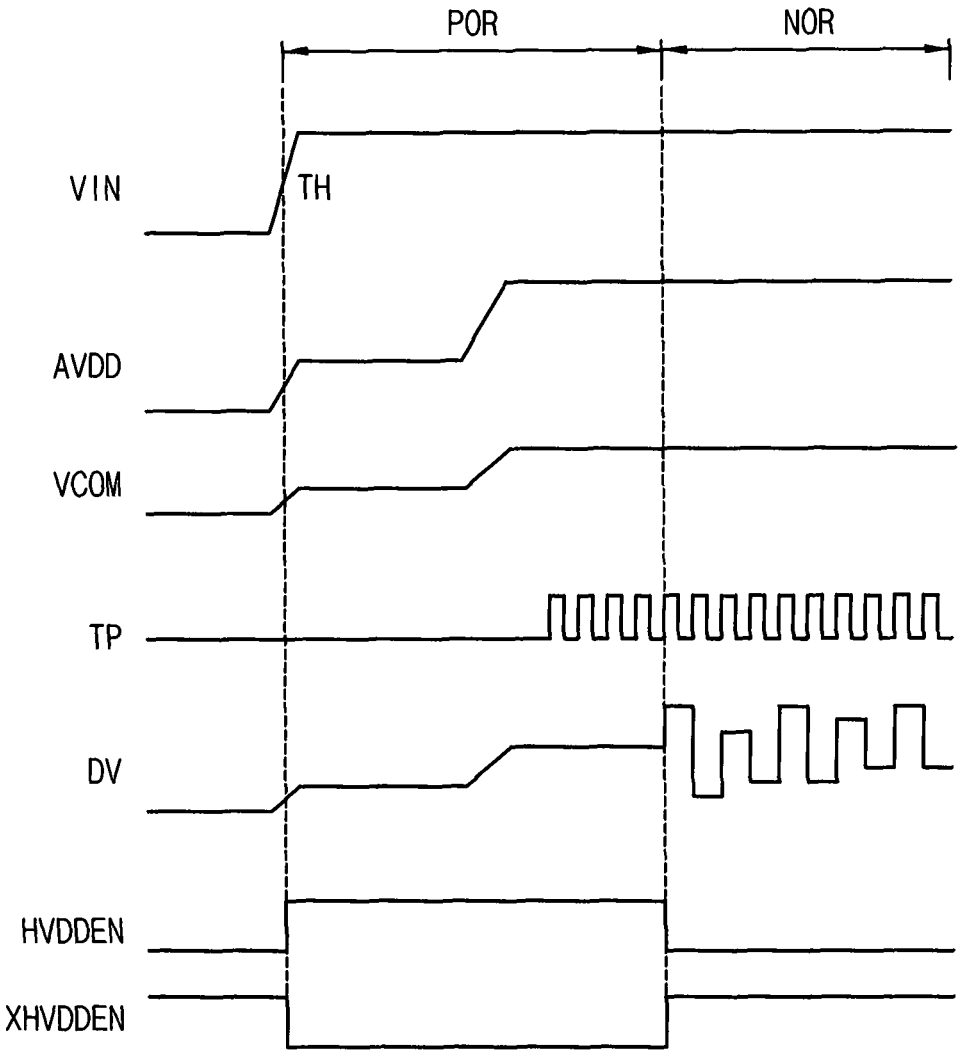
FIG. 5 is a timing diagram illustrating signals of the display apparatus of FIG. 1.

FIG. 4A is a circuit diagram similar to that of FIG. 3 but illustrating an operation of the data lines driver 500 of FIG. 3 in an initial driving time. FIG. 4B is a circuit diagram similar to that of FIG. 3 but illustrating an operation of the data lines driver 500 of FIG. 3 in a normal driving time. FIG. 5 is a timing diagram illustrating signals of the display apparatus of FIGS. 1 and 3.

Referring to FIGS. 1 to 5, when the display apparatus is first turned on, capacitances within the power supply charge up and the input voltage VIN gradually increases. The power-on/reset control part 564 detects the increasing input voltage VIN. More specifically, when the input voltage VIN exceeds the predetermined threshold TH, the power-on/reset control part 564 sets the power-on/reset signal HVDDEN to a high level and the inverted power-on/reset signal XHVDDEN to a low level (POR duration in FIG. 5).

When the power-on/reset signal HVDDEN has the high level and the inverted power-on/reset signal XHVDDEN has the low level, the first switching element T1 and the second switching element T2 of the initial data voltage generating part 562 are both turned on as is indicated in FIG. 4A. When the first switching element T1 and the second switching element T2 are turned on, the initial data voltage generating part 562 generates the initial data voltage DVP based on the first power voltage AVDD and the second power voltage VSS.

When the power-on/reset signal HVDDEN has the high level and the inverted power-on/reset signal XHVDDEN has the low level, the third switching element T3 of the switching part 566 is turned on and the fourth switching element T4 of the switching part 566 is turned off Thus, the initial data voltage DVP is applied to the data line DL.

The initial data voltage DVP may be proportional to the first power voltage AVDD. When the first resistor R1 has a resistance substantially the same as a resistance of the second resistor R2, the initial data voltage DVP may be close to a half of the first power voltage AVDD. Similarly, the common voltage VCOM may be proportional to the first power voltage AVDD. The common voltage VCOM may be close to a half of the first power voltage AVDD.

Thus, during the initial driving time POR, the initial driving voltage DVP may be substantially the same as (may mimic) the common voltage VCOM. Accordingly, the pixel electrodes are charged to a voltage (DVP) that is not very different from VCOM and the display panel 100 may display an image having a substantially uniform luminance during the initial driving time POR. Therefore, during the initial driving time POR the display apparatus does not display erratic images and customer confidence in the behavior of the display apparatus may be improved.

In addition, when the display panel 100 has a normally black mode in the case where pixel electrode voltage is substantially the same as VCOM, then the display panel 100 displays a black image during the initial driving time POR. When the display panel displays a black image during the initial driving time POR, the user of the display apparatus may feel comfortable that nothing is going wrong with his/her display apparatus.

In FIG. 5, the first power voltage AVDD increases from an initial level to an immediate level in a first step, and increases from the immediate level to a target level in a second step after the display apparatus is turned on. The initial data voltage DVP which is proportional to the first power voltage AVDD increases form an initial level to an immediate level in a first step, and increases from the immediate level to a target level in a second step. Similarly, the common voltage VCOM increases form an initial level to an immediate level in a first step, and increases from the immediate level to a target level in a second step.

Alternatively, the first power voltage AVDD may increase from an initial level to a target level in a single step so that the initial data voltage DVP may increase from an initial level to a target level in a single step according to a structure of a circuit of the display apparatus.

When a time for initiation passes after the turn-on of the display apparatus, the timing controller 200 stably outputs pulses of the load signal TP. When the timing controller 200 stably outputs the load signal TP, the power-on/reset control part 564 receives the power-on/reset control signal CONTP having a high level from the timing controller 200. For example, when the load signal TP includes four consecutive pulses, the power-on/reset control signal CONTP may have the high level.

When the power-on/reset control part 564 receives the power-on/reset control signal CONTP having the high level, the power-on/reset control part 564 sets the power-on/reset signal HVDDEN as a low level and the inverted power-on/reset signal XHVDDEN as a high level (NOR duration).

When the power-on/reset signal HVDDEN has the low level and the inverted power-on/reset signal XHVDDEN has the high level, the first switching element T1 and the second switching element T2 of the initial data voltage generating part 562 are turned off. When the first switching element T1 and the second switching element T2 are turned off, the initial data voltage DVP may have a floating status and power is not consumed in providing the initial data voltage DVP after it is no longer needed.

When the power-on/reset signal HVDDEN has the low level and the inverted power-on/reset signal XHVDDEN has the high level, the third switching element T3 of the switching part 566 is turned off and the fourth switching element T4 of the switching part 566 is turned on. Thus, the normal data voltage DVN outputted from the buffer 540 is applied to the data line DL.

According to the present exemplary embodiment, the data lines driver 500 outputs the initial data voltage DVP proportional to the first power voltage AVDD to the data line DL during the initial driving time POR so that an image having a substantially uniform luminance may be outputted during the initial driving time POR.

In addition, the initial data voltage DVP is substantially the same as the common voltage VCOM, so that the display panel may display a black image in a normally black mode. Thus, the display quality of the display apparatus may be improved during the initial driving time POR.

Figure 6:
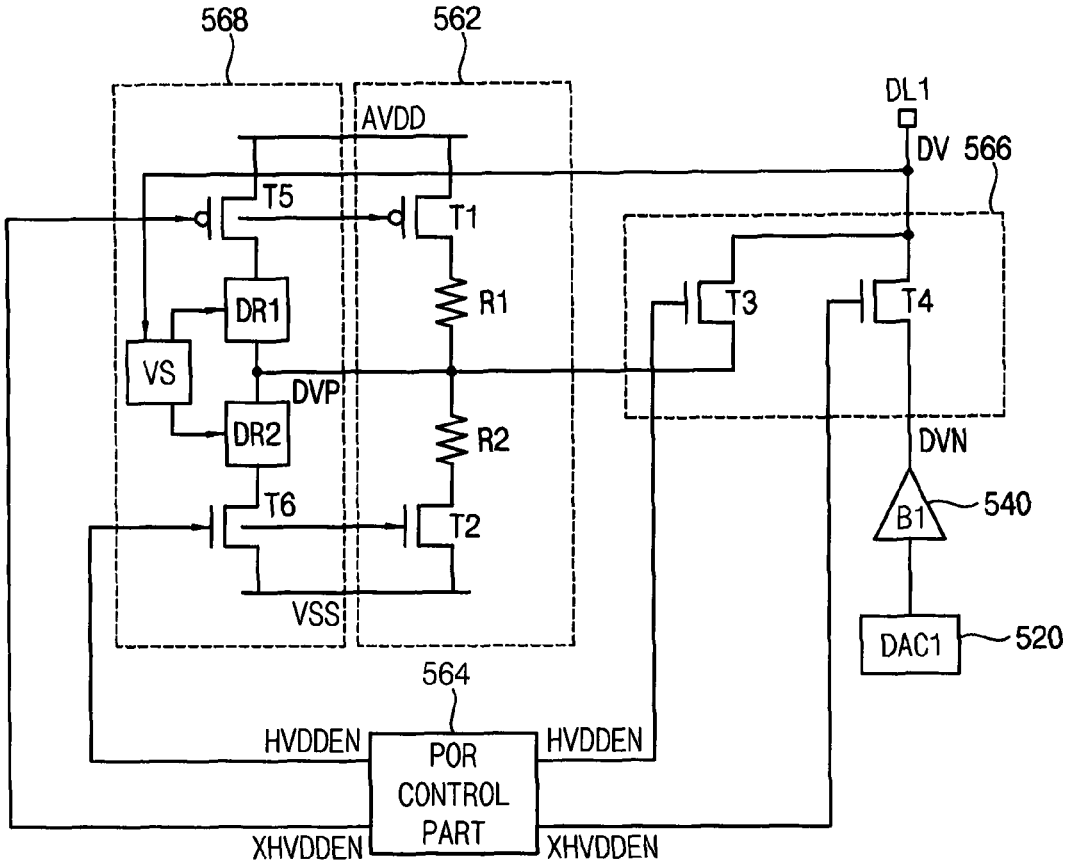
FIG. 6 is a circuit diagram illustrating a data lines driver according to another exemplary embodiment.
Figure 7A:
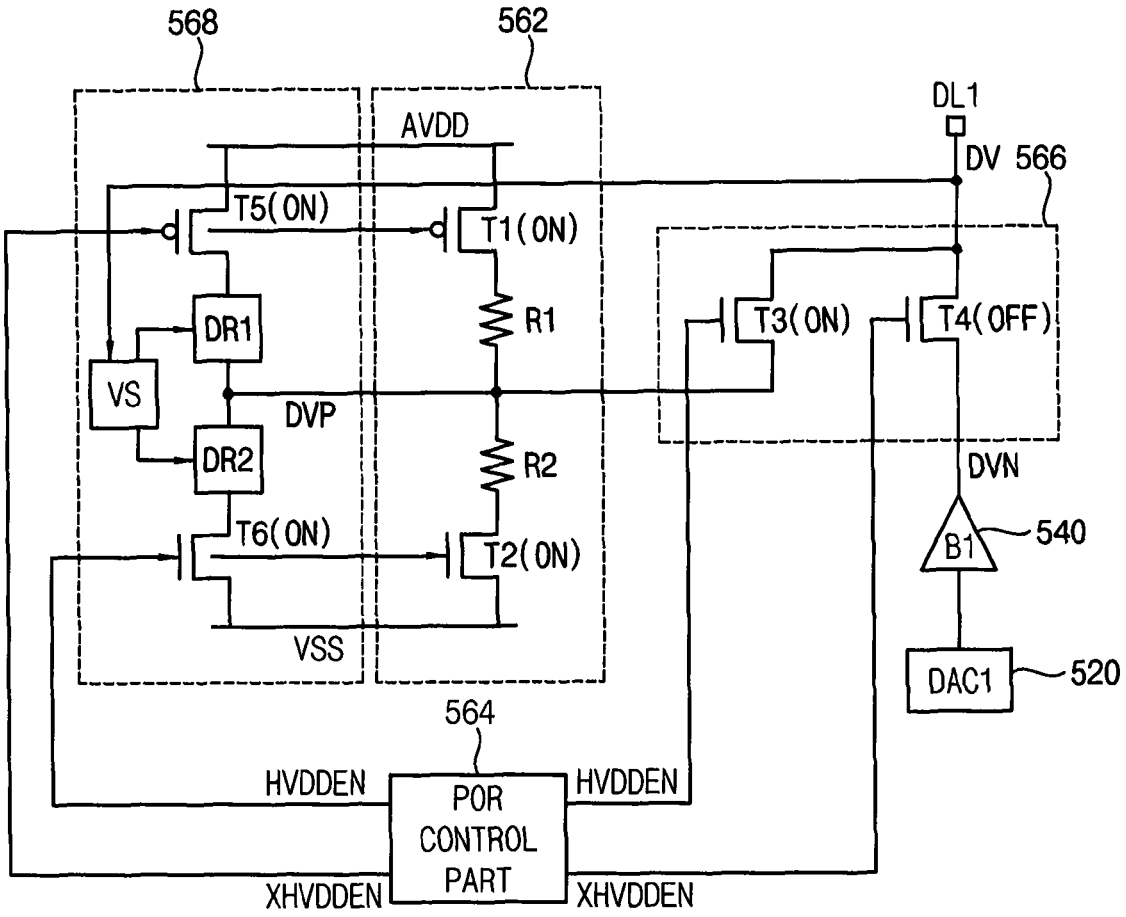
FIG. 7A is a circuit diagram illustrating the data lines driver of FIG. 6 in an initial driving time mode.
Figure 7B:
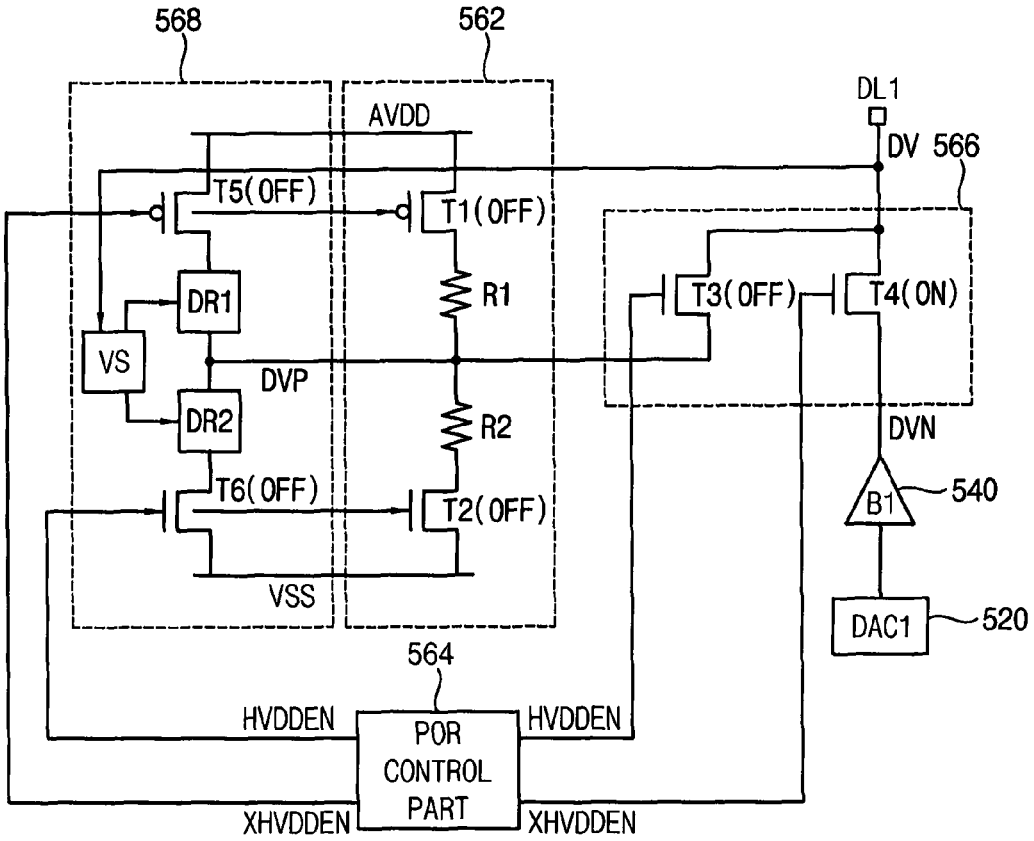
FIG. 7B is a circuit diagram illustrating the data lines driver of FIG. 6 in a normal driving time mode.

FIG. 6 is a circuit diagram illustrating a data lines driver according to another exemplary embodiment. FIG. 7A is a circuit diagram illustrating operation of the data lines driver 500 of FIG. 6 in an initial driving time. FIG. 7B is a circuit diagram illustrating operation of the data lines driver 500 of FIG. 6 in a normal driving time.

The display apparatus according to the present exemplary embodiment is substantially the same as the display apparatus of the previous exemplary embodiment explained referring to FIGS. 1 to 5 except that the power-on/reset part further includes a feedback part 568 (where the DV signal is fed back to the feedback part 568). Thus, the same reference numerals will be used to refer to the same or like parts as those described in the previous exemplary embodiment of FIGS. 1 to 5 and any repetitive explanation concerning the above elements will be omitted.

Referring to FIGS. 1, 2, 5, 6, 7A and 7B, the display apparatus includes a display panel 100 and a panel lines driver. The panel lines driver includes a timing controller 200, a gate lines driver 300, a gamma reference voltage generator 400, a data lines driver 500 and a voltage generator 600.

The data lines driver 500 includes a digital to analog converter 520, a buffer 540 and a power-on/reset part 560.

The digital to analog converter 520 generates a normal data voltage DVN based on the data signal DATA having a digital type and the gamma reference voltage(s) VGREF. The digital to analog converter 520 outputs the normal data voltage DVN to the buffer 540.

The buffer 540 buffers the normal data voltage DVN to maintain a uniform level. The buffer 540 outputs the normal data voltage DVN to the data line DL.

The power-on/reset part 560 generates an initial data voltage DVP varying according to time. The power-on/reset part 560 selectively outputs the initial data voltage DVP or the normal data voltage DVN.

The power-on/reset part 560 includes an initial data voltage generating part 562, a power-on/reset control part 564, a switching part 566 and the feedback part 568.

The initial data voltage generating part 562 generates the initial data voltage DVP based on a first power voltage AVDD and a second power voltage VSS. The first power voltage AVDD may be the analog power voltage received from the voltage generator 600. The second power voltage VSS may be a ground voltage.

For example, the initial data voltage generating part 562 may include a first switching element T1, a first resistor R1, a second resistor R2 and a second switching element T2.

The feedback part 568 is connected to the initial data voltage generating part 562 and stabilizes the initial data voltage DVP.

The feedback part 568 includes a fifth switching element T5 (PMOS), a first digitally controlled resistor DR1, a second digitally controlled resistor DR2, a sixth switching element T6 (NMOS) and a voltage sensing part VS that outputs digital control signals to the first and second digitally controlled resistor DR1 and DR2. The fifth switching element T5, the first digital resistor DR1, the second digital resistor DR2 and the sixth switching element T6 are connected to one another in series.

The fifth switching element T5 includes a control electrode to which the inverted power-on/reset signal HVDDEN is applied, an input electrode to which the first power voltage AVDD is applied and an output electrode connected to a first end of the first digital resistor DR1.

The first digital resistor DR1 includes the first end connected to the output electrode of the fifth switching element T5 and a second end connected to a first end of the second digital resistor DR2. The second end of the first digital resistor DR1 is connected to the second end of the first resistor R1 of the initial data voltage generating part 562.

The second digital resistor DR2 includes a first end connected to the second end of the first digital resistor DR1 and a second end connected to an input electrode of the sixth switching element T6.

The sixth switching element T6 includes a control electrode to which the power-on/reset signal XHVDDEN is applied, an input electrode connected to the second end of the second digital resistor DR2 and an output electrode to which the second power voltage VSS is applied.

For example, the fifth switching element T5 may be a P-type transistor. For example, the sixth switching element T6 may be an N-type transistor.

The voltage sensing part VS is connected to the first digital resistor DR1 and the second digital resistor DR2. During the power-up mode, the initial data voltage DVP is fed back to the voltage sensing part VS as the analog DV signal. The voltage sensing part VS may be programmed to compare the fed back DV signal against a predetermined and desired value or sequence of values and to appropriately adjust the resistances of the first digital resistor DR1 and the second digital resistor DR2 so that the voltage sensing part VS causes a level of the initial data voltage DVP to be more in accordance with the predetermined and desired value or sequence of values.

Similar to the first and second switching elements, the fifth and sixth switching elements T5 and T6 are turned on when the power-on/reset signal HVDDEN has a high level so that the fifth and sixth switching elements T5 and T6 stabilizes the level of the initial data voltage DVP.

The switching part 566 selectively outputs the initial data voltage DVP and the normal data voltage DVN.

According to the present exemplary embodiment, the data lines driver 500 outputs the initial data voltage DVP proportional to the first power voltage AVDD to the data line DL during the initial driving time POR so that an image having a substantially uniform luminance may be outputted during the initial driving time POR.

In addition, the initial data voltage DVP is substantially the same as the common voltage VCOM, so that the display panel may display a black image in a normally black mode. Thus, the display quality of the display apparatus may be improved during the initial driving time POR.

According to the present inventive concept(s) as explained above, the proper initial data voltage is outputted to the data lines during the initial driving time so that the display quality of the display panel may be improved.

The foregoing is illustrative of the present inventive concept(s) and is not to be construed as limiting thereof. Although a few exemplary embodiments of the present inventive concept(s) have been described, those skilled in the art will readily appreciate in light of the foregoing that many modifications are possible in the exemplary embodiments without materially departing from the novel aspects and advantages of the present teachings. Accordingly, all such modifications are intended to be included within the scope of the present teachings. In the claims, means-plus-function clauses are intended to cover the structures described herein as performing the recited function and not only structural equivalents but also equivalent structures.

What is claimed is:

1. A data lines driver for use in a display device, the data lines driver comprising:

a digital to analog converter configured to generate a normal data voltage signal based on a received data signal; and a power-on/reset part configured to generate an initial data voltage signal varying according to time and to selectively output either the initial data voltage signal or the normal data voltage signal for coupling to a corresponding data line of the display device, wherein the power-on/reset part comprises:

an initial data voltage signal generating part configured to generate the initial data voltage signal based on a supplied first power voltage and a supplied second power voltage;

a switching part configured to selectively output either the initial data voltage signal or the normal data voltage signal; and a power-on/reset control part configured to generate a power-on/reset signal and an inverted power-on/reset signal that are coupled to the initial data voltage signal generating part and to the switching part for thereby controlling respective operations of the initial data voltage signal generating part and of the switching part, wherein the power-on/reset part comprises a fifth switching element, a first digital resistor, a second digital resistor, a sixth switching element, a voltage sensing part and a feedback part, and wherein:

the fifth switching element, the first digital resistor, the second digital resistor and the sixth switching element are connected to one another in series, the voltage sensing part is connected to the first digital resistor and the second digital resistor, and the feedback part is configured to stabilize the initial data voltage.

2. The data lines driver of claim 1, wherein:

the power-on/reset control part is configured to receive an input voltage provided by a power supply of the display device and a power-on/reset control signal indicating a start of a normal operation of a timing controller of the display device, the power-on/reset control part is configured to set the power-on/reset signal as a high level and the inverted power-on/reset signal as a low level when the input voltage begins to exceed a predetermined threshold, and the power-on/reset control part is configured to set the power-on/reset signal as a low level and the inverted power-on/reset signal as a high level when the power-on/reset control signal has a high level.

3. The data lines driver of claim 1, wherein the switching part comprises:

a third switching element comprising a control electrode to which the power-on/reset signal is applied, an input electrode to which the initial data voltage signal is applied and an output electrode connected to the corresponding data line of the display device; and a fourth switching element comprising a control electrode to which the inverted power-on/reset signal is applied, an input electrode to which the normal data voltage signal is applied and an output electrode connected to the corresponding data line.

4. The data lines driver of claim 1, wherein:

the fifth switching element comprises a control electrode to which the inverted power-on/reset signal is applied, an input electrode to which the first power voltage is applied and an output electrode connected to a first end of the first digital resistor, the first digital resistor comprises the first end connected to the output electrode of the fifth switching element and a second end connected to a first end of the second digital resistor, the second digital resistor comprises the first end connected to the second end of the first digital resistor and a second end connected to an input electrode of the sixth switching element, and the sixth switching element comprises a control electrode to which the power-on/reset signal is applied, the input electrode connected to the second end of the second digital resistor and an output electrode to which the second power voltage is applied, and the fifth switching element is a P-type transistor and the sixth switching element is an N-type transistor.

5. The data lines driver of claim 1, wherein the initial data voltage signal is proportional to a first power voltage applied to the power-on/reset part.

6. The data lines driver of claim 5, wherein the initial data voltage is substantially the same as a common voltage signal of the display device.

7. The data lines driver of claim 5, wherein the initial data voltage signal is substantially a half of the first power voltage.

8. A data lines driver for use in a display device, the data lines driver comprising:

a digital to analog converter configured to generate a normal data voltage signal based on a received data signal; and a power-on/reset part configured to generate an initial data voltage signal varying according to time and to selectively output either the initial data voltage signal or the normal data voltage signal for coupling to a corresponding data line of the display device, wherein the power-on/reset part comprises:

an initial data voltage signal generating part configured to generate the initial data voltage signal based on a supplied first power voltage and a supplied second power voltage;

a switching part configured to selectively output either the initial data voltage signal or the normal data voltage signal; and a power-on/reset control part configured to generate a power-on/reset signal and an inverted power-on/reset signal that are coupled to the initial data voltage signal generating part and to the switching part for thereby controlling respective operations of the initial data voltage signal generating part and of the switching part, wherein:

the initial data voltage signal generating part comprises a first switching element, a first resistor, a second resistor and a second switching element, and the first switching element, the first resistor, the second resistor and the second switching element are connected to one another in series, and wherein:

the first switching element comprises a control electrode to which the inverted power-on/reset signal is applied, an input electrode to which the first power voltage is applied and an output electrode connected to a first end of the first resistor, the first resistor comprises the first end connected to the output electrode of the first switching element and a second end connected to a first end of the second resistor, the second resistor comprises the first end connected to the second end of the first resistor and a second end connected to an input electrode of the second switching element, the second switching element comprises a control electrode to which the power-on/reset signal is applied, the input electrode connected to the second end of the second resistor and an output electrode to which the second power voltage is applied, and the first switching element is a P-type transistor and the second switching element is an N-type transistor.

9. A display apparatus comprising:

a display panel configured to display an image;

a timing controller configured to generate a data signal based on input image data;

a voltage generator configured to generate a digital power voltage, an analog power voltage and a common voltage based on an input voltage, to output the digital power voltage to the timing controller and to a data lines driver, to output the analog power voltage to the data lines driver and to output the common voltage to the display panel; and wherein the data lines driver comprises a digital to analog converter configured to generate a normal data voltage based on a data signal, a buffer configured to buffer the normal data voltage and a power-on/reset part configured to generate an initial data voltage varying according to time and to selectively output the initial data voltage or the normal data voltage, wherein the power-on/reset part comprises:

an initial data voltage generating part configured to generate the initial data voltage based on the analog power voltage and a second power voltage;

a switching part configured to selectively output the initial data voltage and the normal data voltage;

a power-on/reset control part configured to generate a power-on/reset signal and an inverted power-on/reset signal to control an operation of the initial data voltage generating part and the switching part; and a fifth switching element, a first digital resistor, a second digital resistor, a sixth switching element, a voltage sensing part and a feedback part, and wherein:

the fifth switching element, the first digital resistor, the second digital resistor and the sixth switching element are connected to one another in series;

the voltage sensing part is connected to the first digital resistor and the second digital resistor; and the feedback part is configured to stabilize the initial data voltage.

10. The display apparatus of claim 9, wherein:

the initial data voltage generating part comprises a first switching element, a first resistor, a second resistor and a second switching element, and the first switching element, the first resistor, the second resistor and the second switching element are connected to one another in series.

11. The display apparatus of claim 9, wherein:

the power-on/reset control part is configured to receive the input voltage and a power-on/reset control signal representing a normal operation of the timing controller, when the input voltage exceeds a threshold, the power-on/reset control part is configured to set the power-on/reset signal as a high level and the inverted power-on/reset signal as a low level, and when the power-on/reset control signal has a high level, the power-on/reset control part is configured to set the power-on/reset signal as a low level and the inverted power-on/reset signal as a high level.

12. The display apparatus of claim 9, wherein the switching part comprises:

a third switching element comprising a control electrode to which the power-on/reset signal is applied, an input electrode to which the initial data voltage is applied and an output electrode connected to a data line; and a fourth switching element comprising a control electrode to which the inverted power-on/reset signal is applied, an input electrode to which the normal data voltage is applied and an output electrode connected to the data line.

13. The display apparatus of claim 9, wherein the display panel has a normally black mode.

14. The display apparatus of claim 9, wherein the initial data voltage is proportional to the analog power voltage.

15. A method of driving a display panel including a power-on/reset part that comprises a fifth switching element, a first digital resistor, a second digital resistor, a sixth switching element, a voltage sensing part and a feedback part, the method comprising:

generating a data signal based on input image data;

generating a normal data voltage based on the data signal;

generating an initial data voltage varying according to time based on an analog power voltage and a second power voltage;

generating a power-on/reset signal and an inverted power-on/reset signal to control an operation of selectively outputting either the initial data voltage or the normal data voltage to a corresponding data line of the display panel;

applying the power-on/reset signal to the fifth switching element and the inverted power-on/reset signal to the sixth switching element;

applying the initial data voltage to the voltage sensing part; and operating the feedback part to the initial data voltage, and wherein:

the fifth switching element, the first digital resistor, the second digital resistor and the sixth switching element are connected to one another in series, and the voltage sensing part is connected to the first digital resistor and the second digital resistor.

* * * * *